US008205656B2

(12) United States Patent
Ma

(10) Patent No.: US 8,205,656 B2
(45) Date of Patent: Jun. 26, 2012

(54) ADJUSTABLE AWNING SUPPORT JOINT

(76) Inventor: Oliver Joen-an Ma, Arcadia, CA (US)

( * ) Notice: Subject to any disclaimer, the term of this patent is extended or adjusted under 35 U.S.C. 154(b) by 109 days.

(21) Appl. No.: 12/502,388

(22) Filed: Jul. 14, 2009

(65) Prior Publication Data

US 2010/0032106 A1 Feb. 11, 2010

(30) Foreign Application Priority Data

Jul. 14, 2008 (CN) ..... 2008 2 0121331

(51) Int. Cl.
*E04F 10/06* (2006.01)

(52) U.S. Cl. ..... 160/22; 160/59; 160/70; 160/45; 403/52; 403/119

(58) Field of Classification Search ..... 160/22, 160/59, 70, 62, 64, 66, 45, 78; 248/616; 403/52, 119; 135/117, 88.1, 88.12, 88.11
See application file for complete search history.

(56) References Cited

U.S. PATENT DOCUMENTS

| | | | | |
|---|---|---|---|---|
| 2,740,470 A | | 4/1956 | D'azzo | |
| 3,923,074 A | * | 12/1975 | McKee | 160/22 |
| 3,991,805 A | | 11/1976 | Clauss | |
| 4,479,526 A | | 10/1984 | Rinaldi | |
| 4,566,516 A | | 1/1986 | Lohausen | |
| 4,590,642 A | | 5/1986 | Hesener | |
| 4,673,017 A | | 6/1987 | Lauzier | |
| 4,784,204 A | | 11/1988 | Lohausen | |
| 5,029,363 A | | 7/1991 | Hesener | |
| 5,133,397 A | | 7/1992 | Lohausen | |
| 5,273,095 A | | 12/1993 | Lukos | |
| 5,307,856 A | * | 5/1994 | Murray | 160/70 |
| 5,365,989 A | * | 11/1994 | Eger et al. | 160/22 |
| 5,394,921 A | | 3/1995 | Lohausen | |
| 5,752,556 A | | 5/1998 | Steadman | |

(Continued)

FOREIGN PATENT DOCUMENTS

CH 625300 9/1981

(Continued)

OTHER PUBLICATIONS

Dictionary.com, "arcuate," in Collins English Dictionary—Complete & Unabridged 10th Edition. Source location: HarperCollins Publishers. http://dictionary.reference.com/browse/arcuate. Available: http://dictionary.reference.com. Accessed: Dec. 9, 2010.*

(Continued)

*Primary Examiner* — Katherine w Mitchell
*Assistant Examiner* — Johnnie A Shablack
(74) *Attorney, Agent, or Firm* — Knobbe, Martens, Olson & Bear LLP

(57) ABSTRACT

An awning includes a support member, an extension member, and an adjustment device. The extension member has a first end, a second end, and a longitudinal axis extending therebetween. The first end of the extension member couples with an edge of a cloth. The adjustment device includes at least two positioning frames coupled to the support member and a Y-shaped support frame disposed between the positioning frames. The Y-shaped support frame has an upper fork, a lower fork, and a base coupled to the second end of the extension member. The adjustment device is configured to pivotally move the extension member upward and downward. The longitudinal axis of the extension member is disposed at a range of angular positions relative to a horizontal axis.

20 Claims, 6 Drawing Sheets

U.S. PATENT DOCUMENTS

| | | | | |
|---|---|---|---|---|
| 6,484,069 | B2 | 11/2002 | Osinga et al. | |
| 6,598,612 | B1 * | 7/2003 | Crowe | 135/88.12 |
| 6,732,018 | B2 | 5/2004 | Osinga | |
| 6,874,558 | B2 | 4/2005 | Mester | |
| 6,904,826 | B2 | 6/2005 | Hesener | |
| 7,163,042 | B2 | 1/2007 | Li | |
| 2007/0193700 | A1 | 8/2007 | Ornelas et al. | |
| 2007/0199662 | A1 * | 8/2007 | Miller | 160/23.1 |
| 2010/0032106 | A1 * | 2/2010 | Ma | 160/22 |

FOREIGN PATENT DOCUMENTS

| | | |
|---|---|---|
| DE | 2613583 | 3/1976 |
| EP | 1342864 | 9/2003 |
| FR | 2564521 | 11/1985 |

OTHER PUBLICATIONS

Partial European Search Report, EP 09 25 1792, Oct. 26, 2011.
Extended European Search Report, EP 09 25 1792, Mar. 2, 2012.

* cited by examiner

ADJUSTABLE AWNING SUPPORT JOINT

CROSS-REFERENCE TO RELATED APPLICATIONS

This Application claims priority under 35 U.S.C. §119 to Chinese Patent Application No. 200820121331.0, filed 14 Jul. 2008, the entirety of which is hereby incorporated by reference.

BACKGROUND OF THE INVENTIONS

1. Field of the Invention

This application is directed to the adjustment of extending apparatuses, and particularly to a support joint for an adjustable awning.

2. Description of the Related Art

During certain hours, days, and/or seasons, the shade and shelter of an awning may be desirable. However, during other times one may prefer to remain exposed to the elements absent an awning. Further, at some times one may desire to remove an awning for practical concerns such as to provide clearance for maintenance or to prevent damage to the awning during extreme weather. Accordingly, a retractable awning is desirable. Further, at times it may be desirable to have an adjustable awning, allowing the awning to be adjusted in length, angle, or other properties.

Awning supports have been developed to provide a retractable and adjustable awning. However, such awnings are frequently difficult to (dis)assemble, lack stability, flail about in the wind, and provide further disadvantages. Thus, there is a need for an improved adjustable awning support.

SUMMARY OF THE INVENTIONS

In one embodiment an awning can include a support member, an extension member, and an adjustment device. The extension member can have a first end, a second end, and a longitudinal axis extending therebetween. The first end of the extension member can be coupled with an edge of a cloth. The adjustment device can include at least two positioning frames coupled to the support member and a Y-shaped support frame disposed between the positioning frames. The Y-shaped support frame can have an upper fork, a lower fork, and a base coupled to the second end of the extension member. The adjustment device can be configured to pivotally move the extension member upward and downward. The longitudinal axis of the extension member can be disposed at a range of angular positions relative to a horizontal axis.

In another embodiment, an awning assembly can include a support member, a positioning frame, a support frame, an extension member, and an adjusting device. The positioning frame can rigidly attach to the support member and include at least one elongate member. The supporting frame can include at least one path receiving the elongate member, a threaded bore at an end of the path, and a mounting end. The extension member can mount to the supporting frame at the mounting end. The adjustment device can include at least a screw that can engage with the threaded bore such that motion of the screw through the threaded bore causes relative movement between the elongate member and the supporting frame along the path.

In a further embodiment, an awning assembly can include a support member, a positioning frame, a supporting frame, and an extension member. The positioning frame can rigidly attach to the support member and include at least two elongate members. The supporting frame can include a mounting end and at least one path rotatably and translationally receiving the two elongate members. The elongate member can be received such that they are restricted to a defined path defining a position and orientation angle of the supporting frame. The extension member can be mounted to the supporting frame at the mounting end.

BRIEF DESCRIPTION OF THE DRAWINGS

Some preferred embodiments of the inventions will now be more particularly described by reference to the accompanying drawings, in which.

DETAILED DESCRIPTION OF THE PREFERRED EMBODIMENTS

Figure 1:
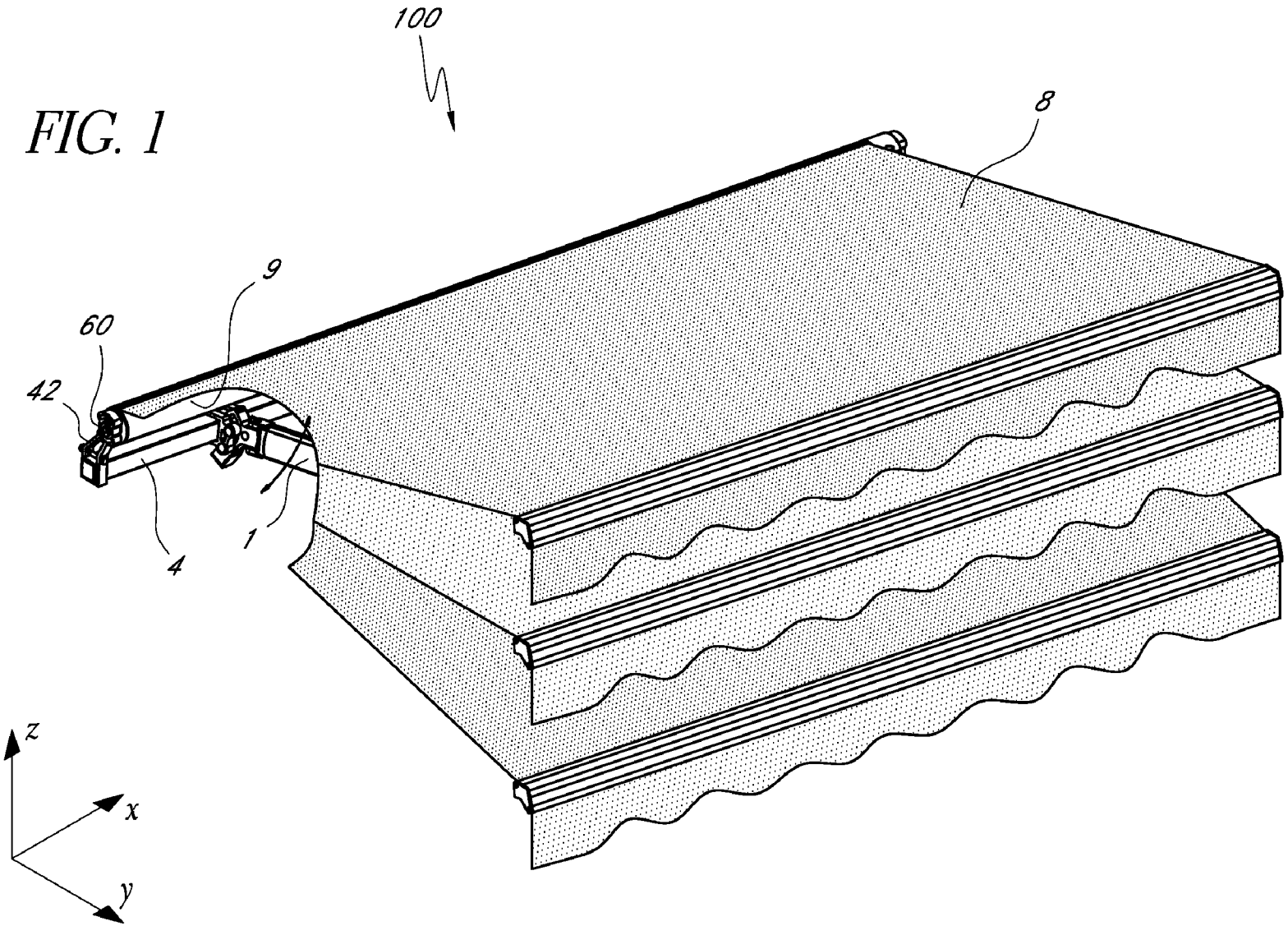
FIG. 1 depicts an embodiment of an awning mounted on a support member by a joint structure, with additional possible positions of the cloth depicted as examples of possible movement.

To assist in the description of these components, the following coordinate terms are used. FIG. 1 depicts an x-y-z Cartesian coordinate system, with the awning assembly primarily lying in the x-y plane. As described herein, terms such as "height" refer to distance in the z-direction, and "higher/upward" and "lower/downward" refer to the positive and negative z-direction, respectively. Similarly, terms such as "lateral" will refer to the x-direction and "longitudinal" will refer to the y-direction. A detailed description of preferred embodiments of awnings and couplings and their associated method of use, now follows.

This application is directed to awnings and couplings, such as joints, that can be used with awnings to selectively provide for relative movement of components that are coupled thereby and to securely connect such components to prevent such relative movement when desirable. As discussed further below, the couplings can also provide substantially improved stability. Further, it will be clear from the discussion below that the couplings described herein can have applications in mechanical apparatuses beyond awnings. Various embodiments of such joints are described below, in connection with the figures.

FIG. 1 depicts one embodiment of an awning assembly 100. The depicted awning assembly 100 includes a support member 4 that can be attached to a primary structure such as a building, free-standing wall, bus, recreational vehicle, or any other structure sufficient to bear the static forces of the awning assembly. In a preferred embodiment the support member 4 has a rectangular cross-section, providing a convenient shape for interengaging with, e.g., the positioning frames 3 (further described below). However, in other embodiments the support member 4 can have other cross-sectional shapes such as being circular, ovoid, triangular, I-beam, T-beam, or another shape. The positioning frames 3 can be shaped to interengage with the particular shape of the support member 4. Further, although the support member 4 is depicted as being substantially straight, in some embodiments it can be curved, have a bend, or have some other lineal discontinuity. The shape of the remaining awning assembly 100 can be accordingly shaped and/or angled to coincide with the shape of the support member 4.

Opposite the support member 4, the awning assembly 100 can include an extension member 1. The extension member 1 can have geometric properties similar to those described above regarding the support member 4. The extension member 1 can also be configured to extend longitudinally from the support member 4 and provide structural support for the windable cloth 8. The windable cloth 8 can be wound into a spool 60 mounted on the support member 4 via an additional clamping bolt 42. In some embodiments, the extension members 1 can have one or more means for retracting, such as telescoping members, hinges, or other collapsible features. Thus, as the cloth 8 is wound the extension member 1 can retract and/or fold. At a near end, the extension member 1 can include a fork 80 that can mount the support frame 2, as discussed further below.

The positioning frame 3 can include a clamp 33 that facilitates mounting of the positioning frame to the support member 4. The clamp 33 can have two tines configured to engage with opposite sides of the support member 4. The tines can further include through holes 34 at their ends through which a clamping bolt 42 can pass through and engage a clamping nut 43 outside the opposite tine. Tightening the nut 43 can force the tines together, exerting a grip on the support member 4 to stabilize the positioning frame 3. Notably, although the depicted straight tines of the clamp 33 can provide a superior grip about a rectangular support member 4, the tines can still provide a substantial grip about other-shaped support members, and other-shaped tines could also provide a substantial grip about the support member 4. In other embodiments, different mechanisms for mounting the positioning frame 3 to the support member 4 can be used, such as a support member with a threaded bore to directly receive a bolt, snap-fit apparatuses, or other mechanisms know in the art.

The positioning frame 3 can additionally include one or more through-holes 31, 32. As depicted, the positioning frame 3 includes two through-holes 31, 32, but in other embodiments more or fewer can be provided. The through-holes 31, 32 can be configured to form a slip fit for elongate members depicted as upper and lower support bolts 7*a*, 7*b*, but in other embodiments tighter fits can be used (e.g. a press fit), or looser fits can be used. The support bolts 7 can engage with nuts 40 to firmly mount the positioning frame 3. Notably, as depicted the support bolts 7 pass through two positioning frames 3 and also one support frame 2, depicted as a Y-shaped support frame. However, in other embodiments other numbers of each can be used. For example, in some embodiments there can be only one positioning frame 3 and one support frame 2. In other embodiments, two support frames 2 can be integrated with one or more positioning frames 3. Additionally, as depicted the support bolts 7*a*, 7*b* extend in a lateral direction as the positioning and support frames 2, 3 extend longitudinally from the support member 4. However, in other embodiments these can extend in other directions, allowing for different shapes and motions of the awning assembly 100. Further, other elongate members can be used such as pins or other cylindrical or non-cylindrical elements.

The support bolts 7*a*, 7*b* can additionally pass through the support frame 2 via pathways 22 formed in or cut-out from the support frame 2. As shown, each pathway 22 can locate on a separate fork 21, 23 of the support frame 2, extending from a base portion 20. However, in other embodiments the support frame 2 can have other shapes, such as a star-configuration, a solid piece, or some other shape. Further, in other embodiments multiple pathways 22 can be provided on each fork 21, 23. Additionally, in some embodiments one pathway 22 can receive more than one support bolt.

Each bolt-pathway combination can form a tight, slidable fit, such that the movement of the support bolts 7*a*, 7*b* relative to the pathway 22 is substantially limited to the shape of the pathway. For example, the pathway 22 can extend in a general direction in a y-z plane and in some embodiments the support bolts 7*a*, 7*b* can be substantially restrained to travel in substantially only that direction. In some embodiments the support bolts 7*a*, 7*b* can have inserted thereover washers 35 to be positioned between the support frame 2 and the positioning frames 3.

As depicted the support frame 2 can have two pathways 22*a*, 22*b* that correspond to the two depicted support bolts 7*a*, 7*b*. The pathways 22 can both generally extend in arcs, although other directions are possible. Additionally, the pathways 22 can be generally concentric, in that they define arcs that have a common center of rotation. However, as discussed further below, other shapes and orientations can be used to define distinct paths of motion for the awning assembly 100. For example, in some embodiments the pathways 22 can be generally kidney-shaped. In other embodiments, the pathways 22 can comprise an L-shape or another generally angular shape.

The support frame 2 can include a base portion 20, distinct from the forks 21, 23. As depicted, the base portion 20 can include a through-hole 44 that can generally align with through-holes 46 on the fork 80 of the extension member 1. A pin, bolt, cylindrical element, or other form of swivel can pass through the holes 44, 46 to provide a rotatable coupling between the extension member 1 and the support frame 2. Further, in the depicted embodiment the swivel can be generally co-planar with the pathways 22. Thus, the swivel can allow rotation generally perpendicular to the motion associated with movement of the support bolts 7*a*, 7*b* through the pathways 22, generally about the support member 4 and the positioning frame 3. In the depicted embodiment the extension member 1 is adapted to allow extension and retraction of the cloth 8, while the motion through the pathways 22 can allow adjustment of the angular position of the cloth 8. This extension and retraction is at least partially made possible by the swivel, which enables the extension member 1 to be folded against the support member 4 in a retracted state and to be extended therefrom in an extended state.

An adjusting cover 5 can also mount on at least one of the support bolts 7. The adjusting cover 5 can mount the support bolt 7 around the support frame 2, between the positioning frames 3. However, in other embodiments it can mount around these elements. As depicted, the adjusting cover 5 mounts the support bolt 7*b* via through-holes 52 on sides 51 of the adjusting cover. The through holes 52 can be generally extended circles, creating an oval-like shape. Thus, the through holes 52 can leave additional room for movement of the support bolt 7*b* in one direction.

Figure 3:
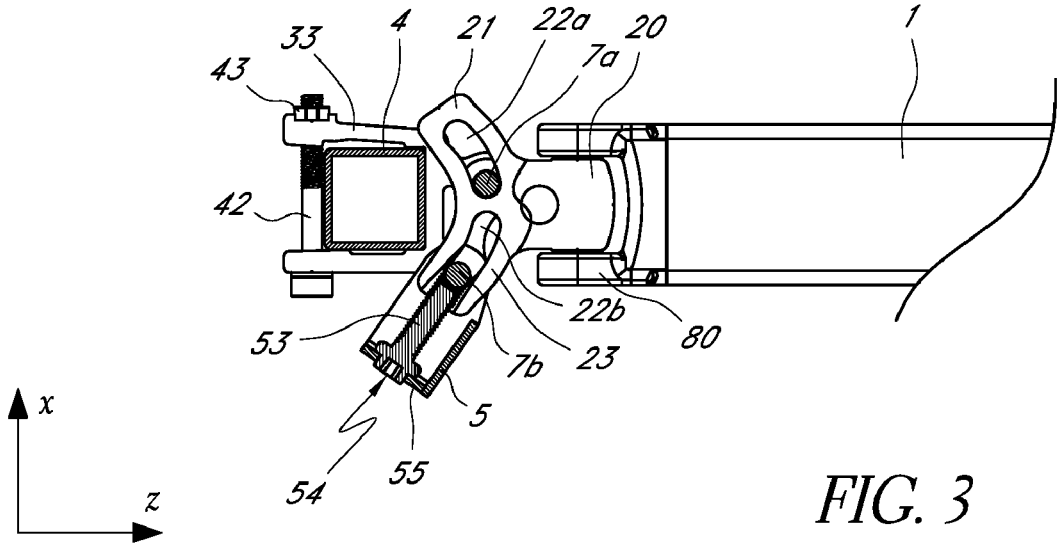
FIG. 3 is a side cross-sectional view of the joint structure of FIG. 1.

The adjusting cover 5 can have an additional through hole located on a back or lower end 55 of the adjusting cover, perpendicular to the support bolt through holes 52. As best shown in FIG. 3, the through hole on the back end 55 can receive an adjusting screw 53. The head of the adjusting screw 53 can generally match the corresponding through hole, leaving relatively little room for relative movement between the screw and the adjusting cover 5 in a direction perpendicular to the axis of the screw. The head portion of the adjusting screw 53 can also prevent relative motion between the adjusting cover 5 and the adjusting screw by hindering relative movement along the axis of the screw. More specifically, the adjusting cover 5 and the adjusting screw 53 can push against each other at the end of the screw head. The adjusting cover 5 can be held by the support bolt 7*b*, such that the cover cannot move away from the screw (while the screw is held by the threaded hole 25). However, in other embodiments there can be room for movement between the adjusting screw 53 and cover 5. For example, in some embodiments those pieces can move relative to each other, and the through holes 52 corresponding to the support bolt 7*b* can be reduced to match the support bolts, hindering translation relative to the support bolt.

The adjusting screw 53 can additionally have a screw hole 54 configured to allow actuation of the screw. For example, the screw hole 54 can have a hexagon-shaped cavity allowing rotation of the adjusting screw 53 with a corresponding hexagon-shaped key 6, although other shapes are possible. As shown, the threads of the adjusting screw 53 can enter a threaded hole 25 on the support frame 2. The threaded hole 25 can be generally aligned with a corresponding portion of the pathway 22, allowing the adjusting screw 53 to thread through the hole and into the pathway.

In use, the actuation of the adjusting screw 53 can cause the awning assembly 100 to adjust positions. A sample starting position is depicted in FIG. 3, with the lower support bolt 7*b* generally adjacent the end of the adjusting screw 53. Thus, the adjusting screw 53, in this embodiment, can approximately define a distance between the support bolt 7*b* and the back end 55 of the adjusting cover 5. A user can rotate the adjusting screw 53 such that it pulls the threaded hole 25 and the support frame 2 downward. This motion can cause the adjusting screw 53 to extend into the pathway 22.

At this point, the support frame 2 can bear the weight of the extension member 1, causing a substantial downward force via, e.g., gravity (in the depicted orientation). However, an upward force can be transmitted to the support frame through the threaded hole 25 whose threads are supported by the adjusting screw 53. The adjusting screw 53 can be supported at its head by the back end 55 of the adjusting cover 5. The adjusting cover 5 can be supported by the support bolt 7*b*, which is in turn supported by the positioning frame 3 and the support member 4.

Figure 4:
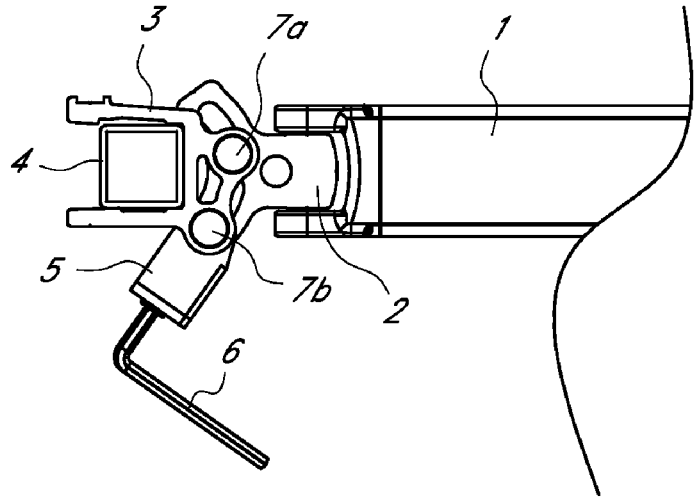
FIG. 4 is a side view of the joint structure of FIG. 1 in a first position.
Figure 5:
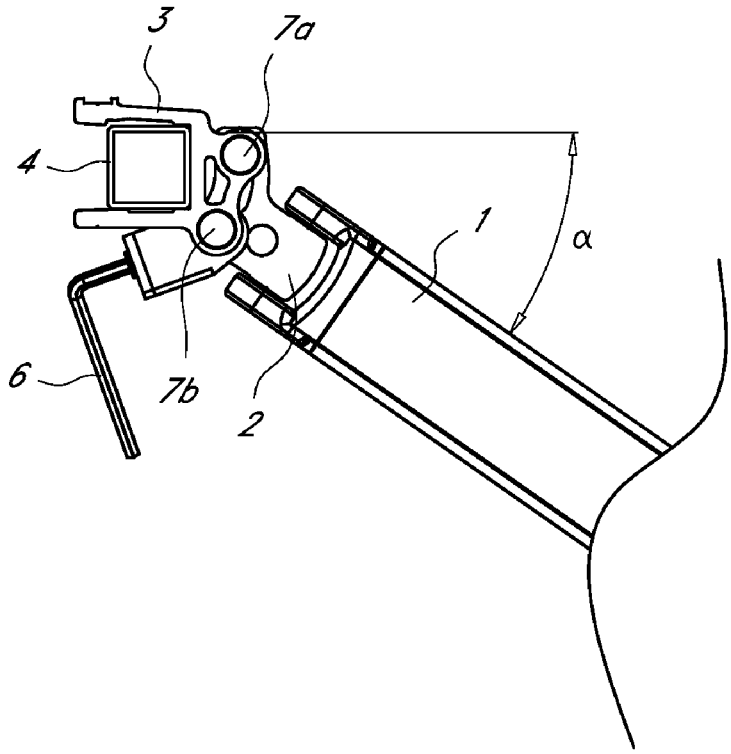
FIG. 5 is a side view of the joint structure of FIG. 1 in a second position.

Thus in the depicted embodiment, as the adjusting screw 53 enters the pathway 22 the support frame 2 can descend, such that the support bolts 7*a*, 7*b* are located at a deeper position relative to the pathways, as depicted in FIG. 5 for example. The ends of the pathways 22 can then define a possible limit to the range of motion of the awning assembly 100. Rotation of the adjusting screw 53 in the opposite direction can raise the support frame 2 back to the position depicted in FIGS. 3, 4. As depicted in FIG. 5, in some embodiments the range of motion "α" of the awning assembly can be approximately 0 to approximately 45 degrees downward from the x-y plane.

Figure 2:
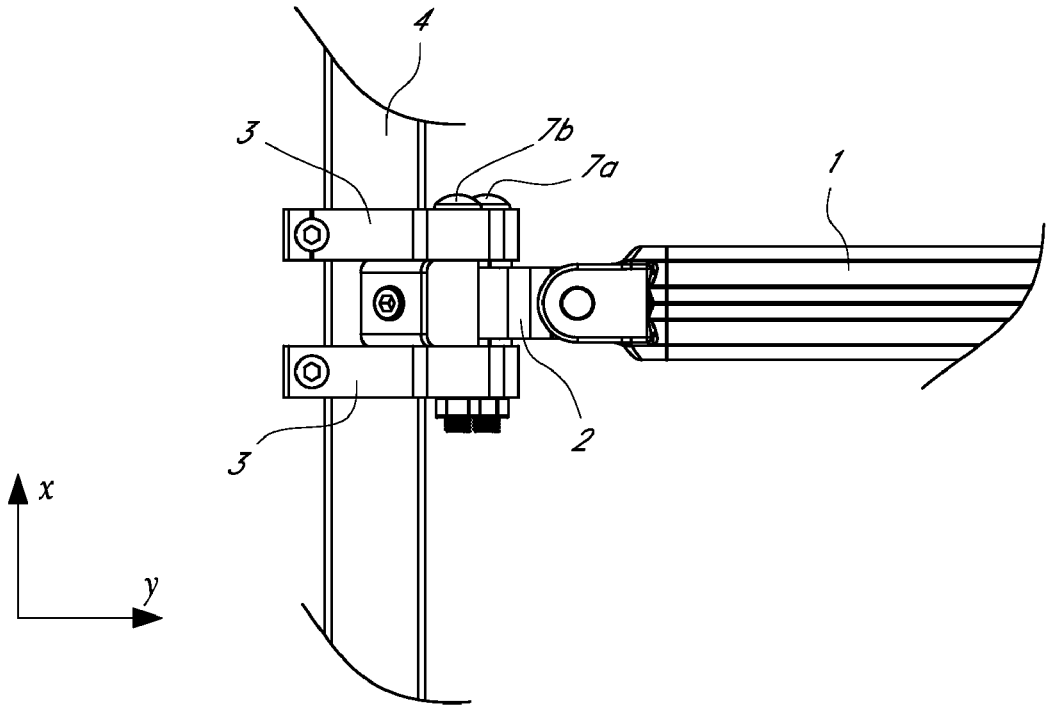
FIG. 2 is a top view of the joint structure of FIG. 1.
Figure 6:
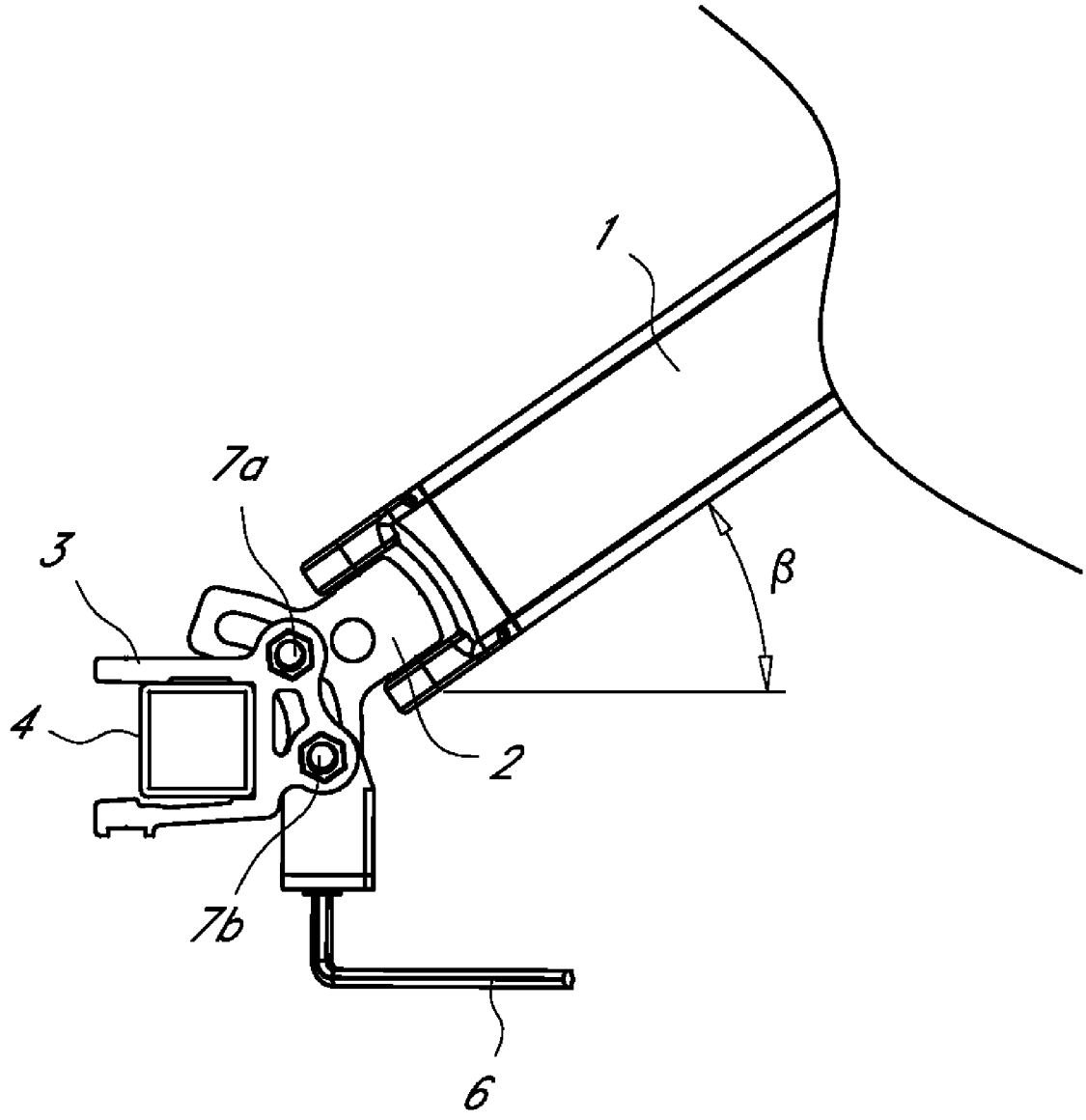
FIG. 6 is a side view of another embodiment of a joint structure.
Figure 7:
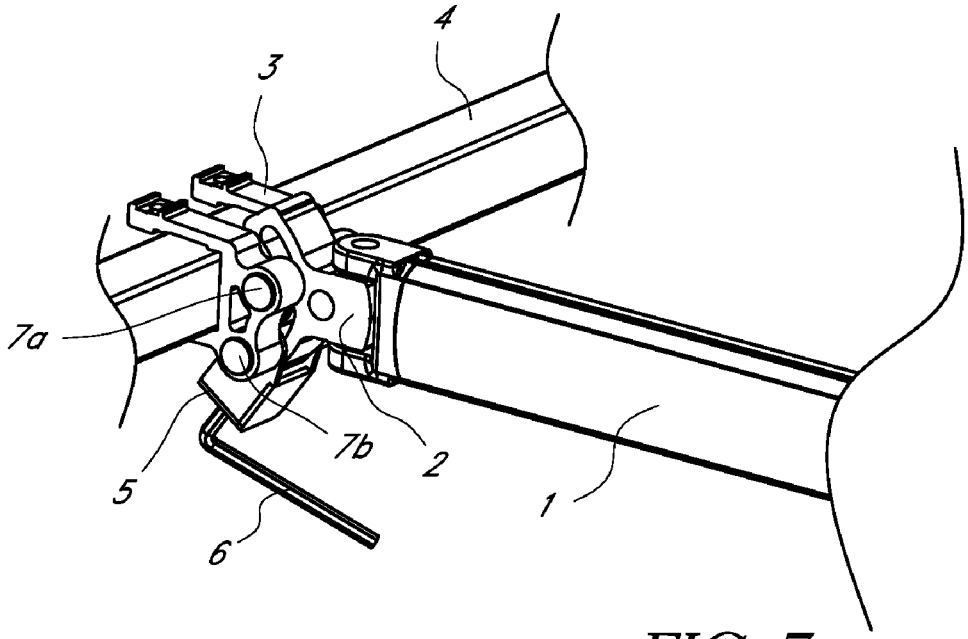
FIG. 7 is a perspective view of the joint structure corresponding to the first position shown in FIG. 4.
Figure 8:
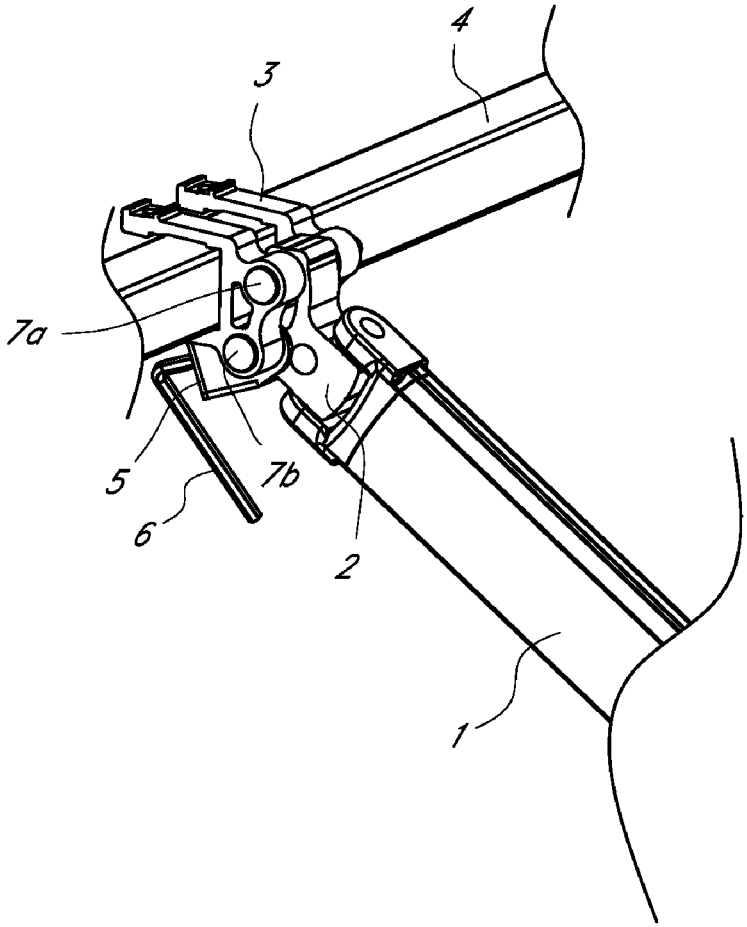
FIG. 8 is a perspective view of the joint structure corresponding to the second position shown in FIG. 5.
Figure 9:
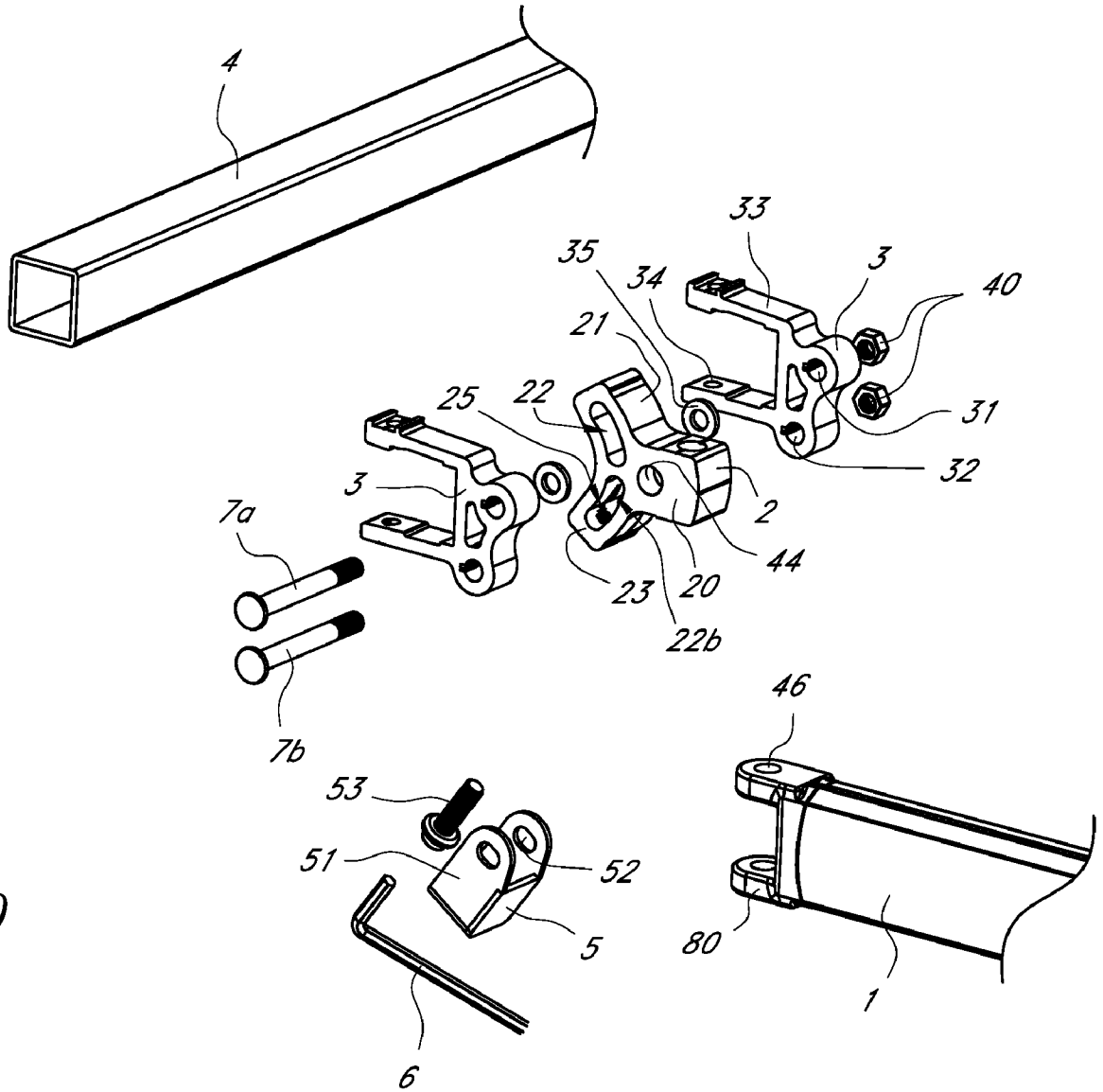
FIG. 9 is an exploded view of the joint structure of FIG. 4.

Notably, the angular orientation of the pathways 22 and the positions of the support bolts 7*a*, 7*b* can define the above-mentioned range of motion. For this range of motion, the support bolts 7*a*, 7*b* can be positioned such that the lower bolt 7*b* is closer to the support member 4 and the pathways 22 can be generally symmetric about a longitudinal axis of the support frame 2 (the axis also aligning with the extension member 1, as best seen in FIGS. 2 and 3). However, in some embodiments the positioning frame 3 can be reversed, such that the upper support bolt 7*a* is closer to the support member 4, as depicted in FIG. 6. In this embodiment, the awning assembly 100 can rotate upward with a range of motion "β" being approximately 0 to 35 degrees from the x-y plane. Accordingly, for a given awning assembly 100 the cover provided can be varied depending upon the orientation of the positioning frame 3.

Additionally, the curvature of the pathways 22 can effect how the awning assembly 100 rotates. In the depicted embodiment the pathways 22 can define concentric circular arcs, with the center of rotation inside the support member 4. This curvature can cause the support bolts 7 to move in a similar arc relative to the support frame 2. Further, as the adjusting cover 5 mounts on the support bolt 7*b*, it too can move relative to the support frame 2. However, in the depicted embodiment the adjusting screw 53 can be fixed relative to the adjusting cover 5 at one end by the back end 55 of the cover. At its other end, the screw 53 can extend through the threaded hole 25 in the support frame 2, holding it in a fixed angular position relative to the frame. Thus, in an initial position depicted in FIG. 3, the screw 53 can be aligned with the support bolts 7*a*, 7*b*. As the bolts 7 move relative to the curved pathways 22 the bolt 7*b* can move out of alignment with the adjusting screw. The extended portions of the through holes 52 on the cover 5 can compensate for such misalignment while holding the screw 53 and cover 5 fixed relative to each other while the cover 5 is still mounted on the support bolt 7*b*.

In other embodiments, the motion of the awning assembly 100 can be further varied. For example, in some embodiments the awning assembly 100 can have a larger or smaller range of motion. In other embodiments, the awning assembly 100 can move in non-circular arcs, or can move in a straight or angular motion.

The embodiments of the inventions described above provide a number of advantages. For example, by providing an adjusting screw 53 with a length spanning substantially the entire distance between the end 55 of the adjusting cover 5 and the support bolt 7*b*, the adjusting screw 53 can provide an additional restraint against unintentional motion or shaking of the awning assembly 100. Additionally, the adjusting screw 53 (at the above-described full length) provides more engaging surface area in the position of FIG. 3 than a shortened adjusting screw. However, the adjusting screw 53 at the above-described full length can, in some embodiments, cause substantial frictional wearing between the screw and the support bolt 7. Accordingly, in some embodiments the adjusting screw 53 can be shorter to minimize such contact.

As another advantage, the provision of two pathways 22 and support bolts 7*a*. 7*b* can reduce undesirable motion of the awning assembly 100. For example, a single circular support bolt could allow rotation of the support frame 2 and the extension member 1 about the bolt. Providing two bolts can control or minimize such movement. Accordingly, the extension member 1 can be held up and prevented from undesirable rotations due to gravity or other external forces. In other embodiments, generally angular, non-cylindrical support bolts can be used to hinder rotation.

Additionally, use of the adjusting cover 5 to transfer forces can provide even further advantages. For example, the cover 5 can at least partially prevent debris, moisture, or other contaminants from contacting the threads of the adjusting screw 53. Further, transmission of force through the cover 5 and the threads of the adjusting screw 53 can prevent substantial transmission of force between the screw and the support bolt 7*b*, which could potentially cause substantial wear. In use, the support bolt 7*b* is maintained in a static position relative to the pathway 22. Accordingly, the cover 5 can reduce vibrations of the awning assembly 100 such as those caused by high winds or other external forces.

Also, as depicted in FIGS. 5 and 6, the awning assembly 100 can be reversed, such that varying angular positions can be achieved. Accordingly, different forms of shelter and/or coverage can be provided. Further, in the position depicted in FIG. 6. Further, different portions of the awning assembly 100 can be concealed from view depending on the orientation.

Although the foregoing description of the preferred embodiment of the present invention has shown, described, and pointed out the fundamental and novel features of the invention, it will be understood that various omissions, substitutions, and changes in the form of the detail of the apparatus as illustrated, as well as the uses thereof, may be made by those skilled in the art without departing from the spirit of the present invention.

What is claimed is:

1. An awning comprising:

a support member;

an extension member with a first end, a second end and a longitudinal axis extending therebetween, the first end coupled with a shade member; and an adjustment device comprising:

at least two positioning frames coupled to the support member;

a Y-shaped support frame disposed between the positioning frames, the Y-shaped support frame having an upper fork, a lower fork and a base coupled to the second end of the extension member, wherein at least one of the forks comprises a threaded hole fixed relative to the at least one fork; and at least one adjustment screw in threaded engagement with the threaded hole, wherein the adjustment device is configured to pivotally move the extension member upward and downward upon rotation of the adjustment screw through the threaded hole;

wherein a longitudinal axis of the extension member can be disposed at a range of angular positions relative to a horizontal axis.

2. The awning in claim 1, wherein the at least two positioning frames comprise clamp members extending therefrom and having bolt holes disposed toward an end of the clamp members, wherein the clamp members are disposed around the support member and clamped by fastening a bolt to the bolt holes.

3. The awning in claim 1, wherein the range of angular positions of the extension member is between 0-45 degrees downward from the horizontal axis.

4. The awning in claim 1, wherein the range of angular positions of the extension member is between 0-35 degrees upward from the horizontal axis.

5. The awning in claim 1, further comprising a spool attached to the cloth and disposed substantially parallel to the support member, the spool being rotatably coupled to the support member for extending and retracting the cloth.

6. The awning in claim 1, further comprising:

at least one arcuate shaped pathway disposed on the Y-shaped support frame; and at least one elongate member disposed through the at least one arcuate shaped pathway and coupled to the at least two positioning frames;

wherein the Y-shaped support frame can move relative to the elongate member along a path defined by the at least one arcuate shaped pathway.

7. The awning in claim 1, further comprising:

at least one kidney shaped pathway disposed on the upper and lower forks of the Y-shaped support frame; and at least one elongate member disposed through the at least one kidney shaped pathway and coupled to the at least two positioning frames;

wherein the Y-shaped support frame can move relative to the elongate member along a path defined by the at least one kidney shaped pathway.

8. The awning in claim 7, further comprising:

an adjusting cover comprising at least two side walls and a bottom wall at a back end, the at least two side walls having clearance holes for passing the at least one elongate member, the bottom wall having a through hole configured to receive the adjustment screw, the adjusting cover being rotatably coupled with the at least one elongate member; and an end portion of the lower fork having a threaded hole concentric with the through hole;

wherein the adjustment screw is free to rotate in the through hole on the bottom wall while engaging the threaded hole of the end portion; and wherein the extension member pivots upward when the adjustment screw is actuated in a first direction and the extension member pivots downward when the adjustment screw is actuated in a second direction.

9. The awning in claim 8, wherein the adjustment screw comprises a hexagon shaped cavity disposed on a head of the adjustment screw for accepting a hex wrench.

10. An awning assembly comprising:

a support member;

a positioning frame rigidly attached to the support member, the positioning frame comprising at least one elongate member;

a supporting frame comprising:

at least one path receiving the elongate member;

a threaded bore fixed at an end of a path; and a mounting end;

an extension member mounted to the supporting frame at the mounting end; and an adjusting device comprising at least a screw that can engage with the threaded bore such that motion of the screw through the threaded bore causes relative movement between the elongate member and the supporting frame along the path.

11. The awning assembly of claim 10, wherein substantially all of a force required to adjust the extension member is applied through the engaged threads of the screw and of the supporting frame.

12. The awning assembly of claim 10, wherein the adjusting device additionally comprises an adjusting cover, the adjusting cover mounted on the elongate member and supporting the adjusting screw.

13. The awning assembly of claim 12, wherein the elongate member is cylindrical and the adjusting cover comprises a generally elongated circular through hole that receives the elongate member.

14. The awning assembly of claim 12, wherein the adjusting screw extends approximately from a back end of the adjusting cover to the elongate member.

15. The awning assembly of claim 14, wherein no substantial forces are transmitted directly between the adjusting screw and the elongate member.

16. An awning assembly comprising:

a support member;

a positioning frame rigidly attached to the support member, the positioning frame comprising at least two elongate members;

a supporting frame comprising a mounting end and at least one path rotatably and translationally receiving the at least two elongate members such that the movement of the supporting frame relative to the at least two elongate members is restricted to a defined path of motion relative to the at least two elongate members defining a position and orientation angle of the supporting frame; and an extension member mounted to the supporting frame at the mounting end, wherein the path of motion is a curved arc.

17. The awning assembly of claim 16, wherein the arc is a circular arc.

18. The awning assembly of claim 17, wherein the center of the circular arc is within the support member.

19. An awning assembly comprising:

a support member;

a positioning frame rigidly attached to the support member, the positioning frame comprising at least two elongate members;

a supporting frame comprising a mounting end and at least one path rotatably and translationally receiving both of the two elongate members such that the movement of the supporting frame relative to the elongate members is restricted to a defined path of motion defining a position and orientation angle of the supporting frame; and an extension member mounted to the supporting frame at the mounting end.

20. The awning assembly of claim 19, wherein one elongate member is nearer the support member than is the other elongate member.

* * * * *